US010037738B2

(12) United States Patent
Kitsomboonloha et al.

(10) Patent No.: US 10,037,738 B2
(45) Date of Patent: Jul. 31, 2018

(54) DISPLAY GATE DRIVER CIRCUITS WITH DUAL PULLDOWN TRANSISTORS

(71) Applicant: Apple Inc., Cupertino, CA (US)

(72) Inventors: Rungrot Kitsomboonloha, Cupertino, CA (US); Chun-Yao Huang, Cupertino, CA (US); Kyung Wook Kim, Cupertino, CA (US); Shih Chang Chang, Cupertino, CA (US); Szu-Hsien Lee, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 80 days.

(21) Appl. No.: 14/862,071

(22) Filed: Sep. 22, 2015

(65) Prior Publication Data

US 2017/0004790 A1 Jan. 5, 2017

Related U.S. Application Data

(60) Provisional application No. 62/188,259, filed on Jul. 2, 2015.

(51) Int. Cl.

| | |
|---|---|
| ***G09G 3/36*** | (2006.01) |
| ***G09G 3/3225*** | (2016.01) |
| ***G09G 3/20*** | (2006.01) |

(52) U.S. Cl.

CPC ..... *G09G 3/3674* (2013.01); *G09G 3/3225* (2013.01); *G09G 3/3648* (2013.01);

(Continued)

(58) Field of Classification Search

CPC .. G09G 3/3648; G09G 3/3674; G09G 3/3225; G09G 2310/0286;

(Continued)

(56) References Cited

U.S. PATENT DOCUMENTS 5,949,398 A * 9/1999 Kim ..... G09G 3/3655 345/100

6,545,653 B1 4/2003 Takahara et al.

(Continued)

FOREIGN PATENT DOCUMENTS

CN 103455201 12/2013

OTHER PUBLICATIONS

Kitsomboonloha et al., U.S. Appl. No. 14/677,531, filed Apr. 2, 2015.

*Primary Examiner* — Darlene M Ritchie

(74) *Attorney, Agent, or Firm* — Treyz Law Group, P.C.; Jason Tsai

(57) ABSTRACT

A display is provided that includes an array of display pixels and gate driver circuitry for providing data and gate line signals to the display pixels. Gate driver circuitry may include gate driver circuits that generate the gate line signals. A gate driver circuit may include at least a buffer transistor, a bootstrapping capacitor coupled to the buffer transistor, a pulldown transistor coupled in series with the buffer transistor, and an isolation transistor coupled to the gate of the pulldown transistor. The buffer transistor may directly receive a first clock signal, whereas the isolation transistor may directly receive a second clock signal that is complementary to the first clock signal. The pulldown transistor is substantially larger than the buffer transistor. The buffer transistor is substantially larger than the isolation transistor. Configured as such, clock loading is minimized while the pulldown transistor is sized to provide the desired fall time performance.

6 Claims, 6 Drawing Sheets

(52) U.S. Cl.
CPC ..... *G09G 3/20* (2013.01); *G09G 2300/0408* (2013.01); *G09G 2310/0267* (2013.01); *G09G 2310/0286* (2013.01); *G09G 2310/0291* (2013.01)

(58) Field of Classification Search
CPC ..... G09G 2310/0291; G11C 19/00; G11C 19/28; G11C 19/282; G11C 19/285
See application file for complete search history.

(56) References Cited

U.S. PATENT DOCUMENTS 6,894,673 B2 5/2005 Koga et al.
7,046,224 B2 5/2006 Monomohshi
7,242,432 B2 7/2007 Watanabe
7,406,253 B2 7/2008 Ueda et al.
7,443,944 B2 10/2008 Tobita et al.
7,477,226 B2 * 1/2009 Kim ..... G11C 19/00 345/100
7,532,701 B2 * 5/2009 Moon ..... G11C 19/00 377/64
7,639,226 B2 * 12/2009 Kim ..... G09G 3/3677 345/100
7,696,974 B2 4/2010 Moon et al.
7,696,975 B2 4/2010 Yang et al.
8,362,999 B2 1/2013 Huang et al.
8,373,483 B2 2/2013 Daily
8,766,961 B2 7/2014 Huang et al.
9,318,219 B2 * 4/2016 Yang ..... G11C 19/28
2006/0022933 A1 * 2/2006 Endo ..... G09G 3/3614 345/98
2008/0198961 A1 * 8/2008 Collins ..... G09G 3/3688 377/70
2008/0218502 A1 * 9/2008 Lee ..... G09G 3/3674 345/208
2009/0167741 A1 * 7/2009 Tsai ..... G09G 3/20 345/211
2010/0171728 A1 * 7/2010 Han ..... G09G 3/3677 345/211
2010/0238143 A1 * 9/2010 Liu ..... G09G 3/20 345/204
2010/0328281 A1 * 12/2010 Okada ..... G11C 19/28 345/206
2011/0193832 A1 * 8/2011 Hirabayashi ..... G02F 1/1368 345/204
2012/0154322 A1 6/2012 Yang et al.
2012/0176360 A1 * 7/2012 Yamashita ..... G09G 3/3233 345/211
2012/0229444 A1 * 9/2012 Ochiai ..... G11C 19/184 345/213
2013/0063404 A1 * 3/2013 Jamshidi Roudbari . G06F 3/044 345/204
2013/0328757 A1 12/2013 Matsumoto et al.
2014/0192039 A1 * 7/2014 Wang ..... G11C 19/28 345/213
2014/0300399 A1 * 10/2014 Miyake ..... G09G 3/3677 327/296
2014/0354590 A1 12/2014 Wang et al.
2014/0361962 A1 12/2014 Yamashita et al.
2014/0362052 A1 12/2014 McCaughan et al.
2015/0036784 A1 * 2/2015 Qing ..... G11C 19/184 377/68
2015/0220194 A1 8/2015 Lin et al.
2015/0255014 A1 * 9/2015 Lin ..... G11C 19/28 345/84
2015/0269897 A1 9/2015 Kitsomboonloha et al.
2015/0294733 A1 * 10/2015 Tan ..... G11C 19/28 345/204
2015/0371716 A1 * 12/2015 Shao ..... G11C 19/287 345/100
2016/0125954 A1 * 5/2016 Gu ..... G11C 19/28 377/64
2016/0217757 A1 * 7/2016 Tanaka ..... G09G 3/3677
2016/0293090 A1 * 10/2016 Long ..... G09G 3/2092
2016/0300542 A1 * 10/2016 Zhang ..... G11C 19/28
2016/0314850 A1 * 10/2016 Gu ..... G11C 19/28
2016/0322116 A1 * 11/2016 Jang ..... G09G 3/20

* cited by examiner

DISPLAY GATE DRIVER CIRCUITS WITH DUAL PULLDOWN TRANSISTORS

This application claims the benefit of provisional patent application No. 62/188,259 filed on Jul. 2, 2015, which is hereby incorporated by reference herein in its entirety.

BACKGROUND

This relates generally to electronic devices and, more particularly, to electronic devices with displays.

Electronic devices often include displays for displaying information to users. The display function in such devices is typically performed by a liquid crystal display (LCD), plasma, or organic light emitting diode (OLED) display element array that is connected to a grid of source (data) and gate (select) metal traces. The display element array is often formed on a transparent panel such as a glass panel, which serves as a protective shield. The data and select lines of the display element array may be driven by a display driver integrated circuit (IC). The driver IC receives an image or video signal, which it then decodes into raster scan pixel values (color or gray scale) and writes them to the display element array during each frame, by driving the data and select lines. This process is repeated at a high enough frame rate so as to render video.

The select lines are sometimes driven using gate driver circuits that are formed directly on the glass panel. Such types of gate driver configuration are sometimes referred to as "gate driver on array" (GOA) technology, which helps to enable a narrower border design for the display. A conventional gate driver typically includes an output transistor that selectively passes through a clock signal. The clock signal is conveyed via a clock routing path that is connected to an entire column of gate drivers. In order to ensure that the amount of capacitive loading on the clock routing path remains below a desired threshold (i.e., to keep power consumption low), the output transistor in each gate driver of the entire column is limited to a certain size.

In high resolution displays with high refresh rates (i.e., refresh rates equal to or greater than 60 Hz) and especially for displays with integrated touch sensing capabilities, it may be challenging to design a gate driver with an output transistor that does not exceed the maximum allowable sizing while meeting performance requirements. It is within this context that the embodiments herein arise.

SUMMARY

In accordance with an embodiment, an electronic device is provided that includes an array of display pixels arranged in rows and columns and gate driver circuitry that is coupled to the array of display pixels and that includes a gate driver having an output at which a corresponding gate line output signal is provided to display pixels arranged along a corresponding row in the array. The gate driver may include a buffer transistor having a first source-drain terminal that receives a clock signal and a second source-drain terminal that is connected to the output and a pulldown transistor that is connected in series with the buffer transistor and that exhibits greater drive strength than the buffer transistor (e.g., the pulldown transistor may be larger in size compared to the buffer transistor).

The gate driver may also include a capacitor having a first terminal that is connected to a gate terminal of the buffer transistor and a second terminal that is connected to the output. The gate driver may also include a clock isolation transistor that receives an additional clock signal that is complementary to the clock signal and that is connected to a gate terminal of the pulldown transistor. The clock isolation transistor may exhibit a smaller drive strength than the buffer transistor (e.g., the clock isolation transistor may be smaller in size compared to the buffer transistor). The buffer transistor and the clock isolation transistor may have gate terminals that are shorted to one another.

The gate driver may also include a first transistor that is coupled in series with the clock isolation transistor and that has a gate terminal, a second transistor that is connected to the buffer transistor and the clock isolation transistor, and a third transistor that is connected in series with the second transistor. The second transistor may have a gate terminal that is shorted to the gate terminal of the first transistor, whereas the third transistor may receive another gate line output signal from a preceding gate driver in the gate driver circuitry.

In accordance with another embodiment, a method for operating a gate driver is provided. The gate driver may include a buffer transistor and a pulldown transistor coupled in series. The method includes generating an output signal at a node that is coupled between the buffer transistor and the pulldown transistor, using only the buffer transistor to pull the output signal high, and using both the buffer transistor and the pulldown transistor to pull the output signal low.

The method also includes receiving a first clock signal at a source-drain terminal of the buffer transistor. The gate driver may further include a clock isolation transistor that is configured to receive a second clock signal that is inverted with respect to the first clock signal and to selectively pass through a low voltage to deactivate the pulldown transistor. The method also includes receiving an asserted set signal to turn on the buffer transistor and the clock isolation transistor, and receiving an asserted reset signal to turn off the buffer transistor, the clock isolation transistor, and the pulldown transistor.

Further features of the present invention, its nature and various advantages will be more apparent from the accompanying drawings and the following detailed description.

DETAILED DESCRIPTION

Figure 1:
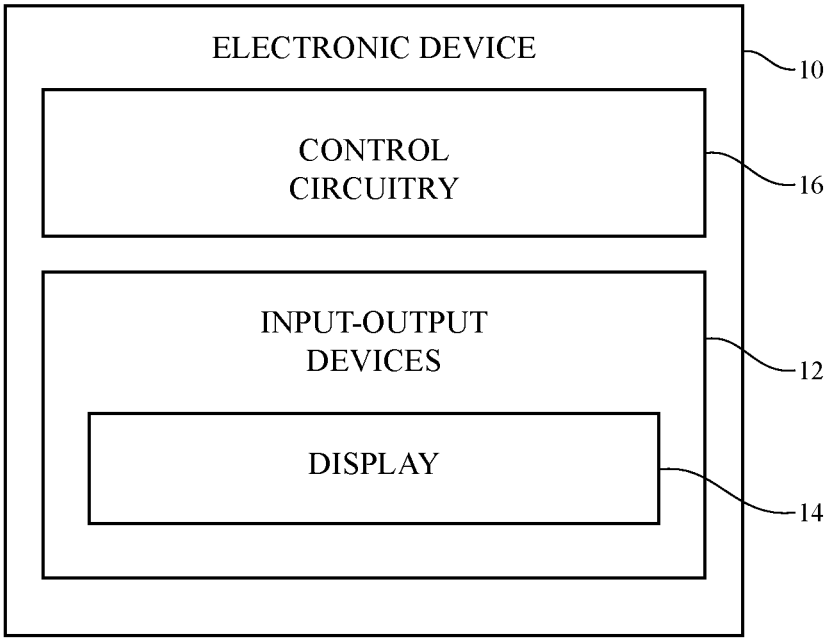
FIG. 1 is a diagram of an illustrative electronic device having a display in accordance with an embodiment.

An illustrative electronic device of the type that may be provided with a display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Figure 2:
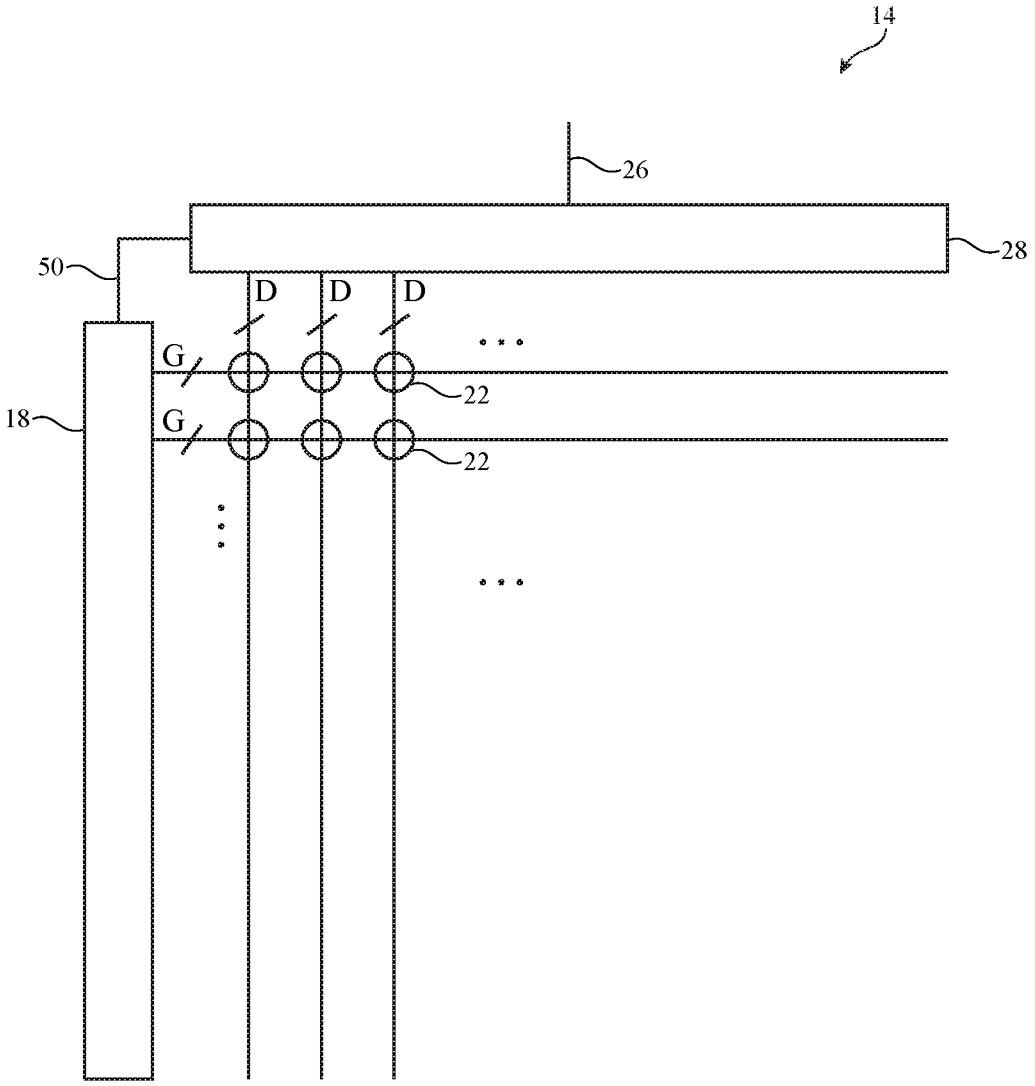
FIG. 2 is a diagram of an illustrative display in accordance with an embodiment.

Control circuitry 16 may be used to run software on device 10 such as operating system code and applications. During operation of device 10, the software running on control circuitry 16 may display images on display 14. Display 14 may be a liquid crystal display, a plasma display, an organic light-emitting diode display, an electrophoretic display, a quantum dot display, or other types of display. FIG. 2 is a diagram showing one suitable arrangement of display 14. As shown in FIG. 2, display 14 may have an array of pixels 22 for displaying images for a user. The array of pixels 22 may be arranged to form rows and columns. There may be any suitable number of rows and columns in the array of pixels 22 (e.g., ten or more, one hundred or more, or one thousand or more). Pixels 22 may each contain subpixels of different colors. As an example, each pixel 22 may have a red subpixel that emits red light, a green subpixel that emits green light, and a blue subpixel that emits blue light. Configurations for display 14 that include subpixels of other colors may be used, if desired.

Display driver circuitry may be used to control the operation of pixels 22. The display driver circuitry may be formed from integrated circuits, thin-film transistor circuits, or other suitable circuitry. Display driver circuitry 28 of FIG. 2 may contain communications circuitry for communicating with system control circuitry such as control circuitry 16 of FIG. 1 over path 26. Path 26 may be formed from traces on a flexible printed circuit or other cable. During operation, the control circuitry (e.g., control circuitry 16 of FIG. 1) may supply circuitry 28 with information on images to be displayed on display 14.

To display the images on display pixels 22, display driver circuitry 28 may supply image data to data lines D while issuing clock signals and other control signals to supporting display driver circuitry such as gate driver circuitry 18 over path 50. If desired, circuitry 28 may also supply clock signals and other control signals to gate driver circuitry on an opposing edge of display 14 (e.g., in a split gate driver configuration).

Gate driver circuitry 18 (sometimes referred to as horizontal control line control circuitry) may be implemented as part of an integrated circuit and/or may be implemented using thin-film transistor circuitry. Horizontal control lines G in display 14 may provide suitable control signals to display pixels 22 arranged along corresponding rows in the array. There may be any suitable number of horizontal control signals per row of pixels 22 (e.g., one or more, two or more, three or more, four or more, etc.).

Each column of pixels 22 preferably includes a sufficient number of data lines to supply image data for all of the subpixels of that column (e.g., a red data line for carrying red data signals to red subpixels, a green data line for carrying green data signals to green subpixels, and a blue data line for carrying blue data signals to blue subpixels).

Each subpixel may be configured depending on the display technology that is being implemented. For example, an organic light-emitting diode (OLED) display subpixel may include an organic light-emitting diode, a drive transistor that controls current flow through the diode, and supporting transistors (e.g., switching transistors and emission enable control transistors). The supporting transistors may be used in performing data loading operations and threshold voltage compensation operations for the drive transistors. Storage capacitors may be used to store data signals between successive frames of data.

As another example, a liquid crystal display (LCD) subpixel may include a storage capacitor and a switching transistor that selectively passes a data signal to the storage capacitor when the corresponding gate line signal is asserted. Depending on the amount of potential that is stored at the capacitor, associated pixel electrode structures may emit an electric field through the liquid crystal material, thereby controlling the amount of light that is transmitted through that subpixel.

Figure 3:
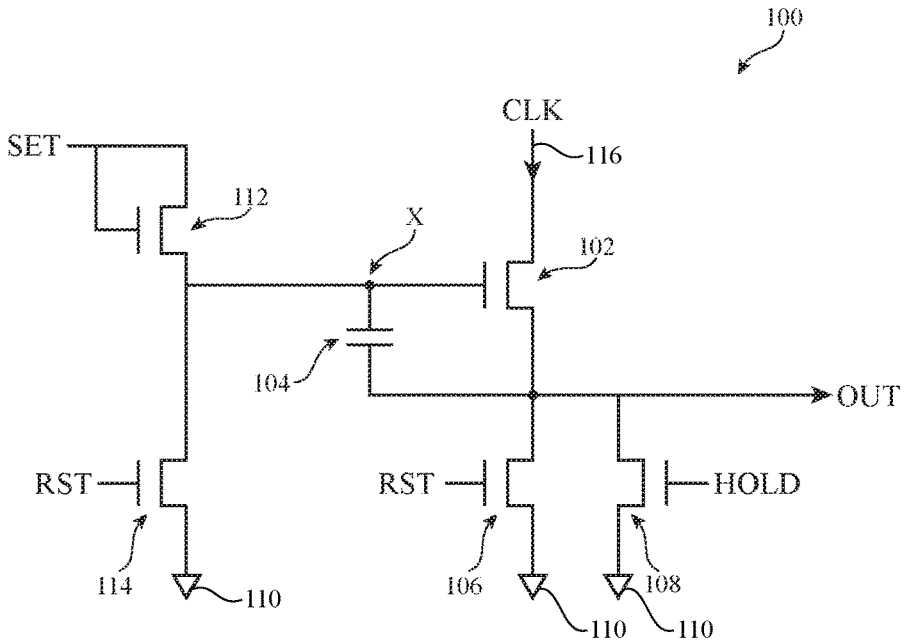
FIG. 3 (PRIOR ART)
FIG. 3 is a circuit diagram of a conventional gate driver.

As described above, the gate lines may be driven using gate driver circuits. FIG. 3 is a circuit diagram of a conventional gate driver 100. As shown in FIG. 3, conventional gate driver 100 includes thin-film transistors 102, 106, 108, 112, and 114 and a capacitor 104. Transistor 102 has a drain terminal at which a clock signal CLK is received via a clock routing path 116, a gate terminal that is connected to node X, and a source terminal that is connected to the output OUT of gate driver 100. Capacitor 104 has a first terminal that is connected to node X and a second terminal that is connected to the gate driver output.

Transistor 106 has a drain terminal that is connected to the gate driver output, a gate terminal that receives reset signal RST, and a source terminal that is connected to a ground line 110. Transistor 108 has a drain terminal that is connected to the gate driver output, a gate terminal that receives hold signal HOLD, and a source terminal that is connected to ground 110. Transistor 112 has a source terminal that is connected to node X and a gate terminal and a drain terminal that receive control signal SET. Transistor 114 has a drain terminal that is connected to node X, a gate terminal that receives the reset signal RST, and a source terminal that is connected to ground 110.

Figure 4:
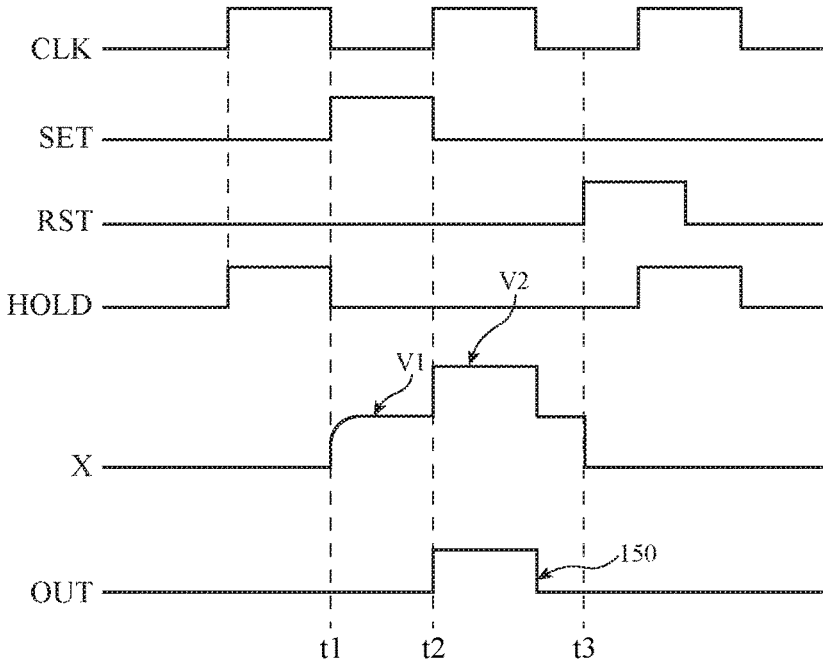
FIG. 4 (PRIOR ART)
FIG. 4 is a timing diagram that illustrates the operation of the gate driver of FIG. 3.

FIG. 4 is a timing diagram that illustrates the operation of conventional gate driver 100. As shown in FIG. 4, signal HOLD may follow the waveform of signal CLK but may be suppressed (i.e., held low at ground) whenever the voltage at node X is asserted. At time t1, signal SET may be pulsed high to drive node X to voltage level V1. At time t2, signal CLK is pulsed high, which pulls node X even higher to voltage level V2, thereby generating a corresponding output pulse at the gate driver output. At time t3, reset signal RST is pulsed high to reset node X back to ground. Gate line output pulses may be generated in this way on a row-by-row basis until data has been written into the entire array of display pixels.

In high resolution displays operating at high refresh rates (e.g., refresh rates at or above 60 Hz), a stringent requirement may be imposed on the fall time of the gate output pulses. For example, performance criteria may specify that the fall time of gate output falling edge 150 in FIG. 4 be less than one microsecond. At the falling edge 150, both transistors 106 and 108 are turned off since control signals RST and HOLD are deasserted at that time. Only transistor 102 is turned on at that time to pull the gate driver output low. As a result, transistor 102 must be sized relatively large to ensure that the fall time of edge 150 meets performance requirements.

As described above, transistor 102 is directly connected to clock routing path 116. Clock routing path 116 is also connected to every other gate driver 100 in a column of gate drivers (see, e.g., gate driver circuitry 18 of FIG. 2). Connected in this way, a large transistor 102 in each gate driver 100 will collectively present a substantially large amount of capacitive loading on the clock routing path 116, which results in an undesirable amount of power consumption to drive the clock signal CLK. Moreover, a large transistor 102 is more susceptible to reliability issues and can more readily degrade over time, causing unpredictable timing variations at the gate driver output.

Figure 5:
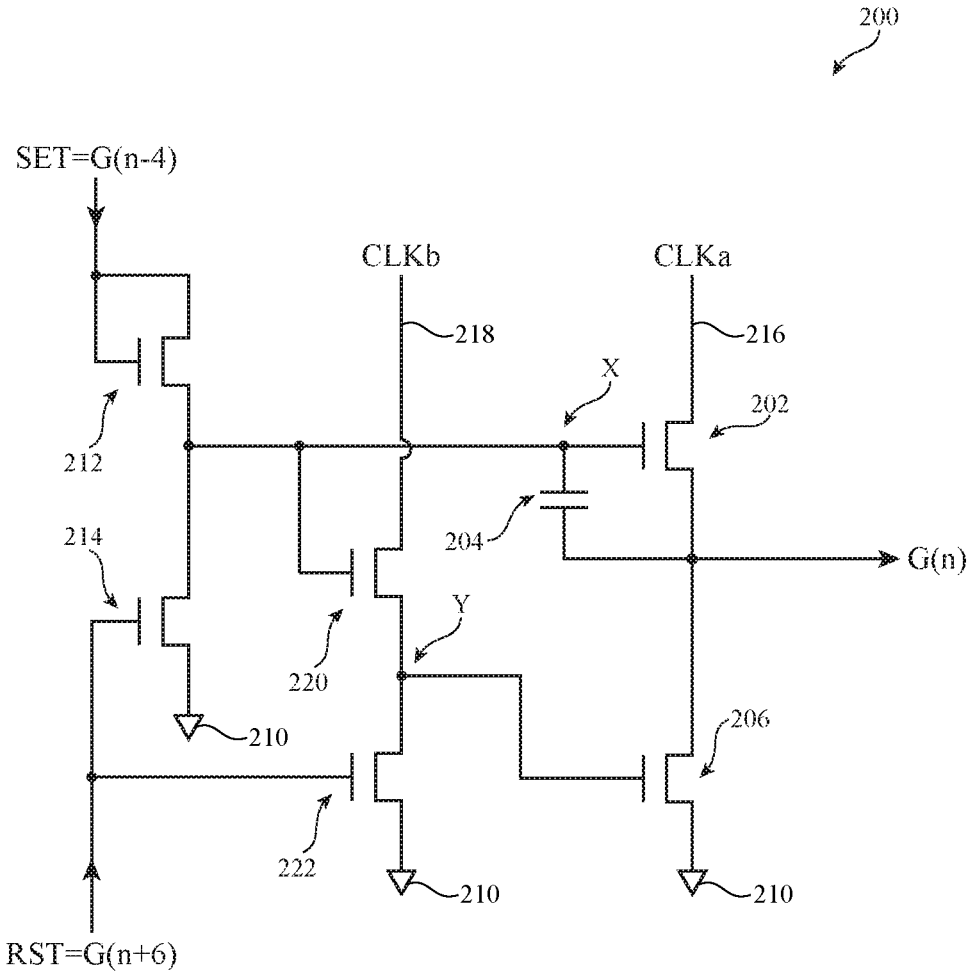
FIG. 5 is a circuit diagram of an illustrative gate driver circuit that includes an additional output pulldown transistor and a clock isolation transistor in accordance with an embodiment.

In accordance with an embodiment of the present invention, a gate driver such as gate driver circuit 200 is provided that can help reduce clock loading while improving fall times (see, e.g., FIG. 5). The improved gate driver 200 includes an additional output pulldown transistor that enables satisfactory fall times and a relatively small clock isolation transistor that minimizes clock loading. As shown in FIG. 5, gate driver 200 may include a capacitor 204 and thin-film transistors 202, 206, 212, 214, 220, and 222. Transistor 202 (sometimes referred to as the output "buffer" transistor) may have a first source-drain terminal that receives a first clock signal CLKa via a first clock routing path 216, a second source-drain terminal that is coupled to the gate driver output (e.g., an output terminal on which gate driver output signal G(n) is provided), and a gate terminal that is coupled to intermediate node X. Capacitor 204 (sometimes referred to as a "bootstrapping" capacitor) has a first terminal that is coupled to node X and a second terminal that is coupled to the gate driver output.

Transistors 212 and 214 may be coupled in series. Transistor 212 may have a source terminal that is coupled to node X, a drain terminal, and a gate terminal that is shorted to its drain terminal. The gate terminal of transistor 212 may be coupled to a feed-forward path on which gate output signal G(n−4) is routed from a preceding gate driver circuit that is four rows above. The signal that is received via the feed-forward path may be used for setting node X to a high potential and is therefore sometimes referred to as a "set" control signal. Transistor 214 may have a drain terminal that is coupled to node X, a source terminal that is coupled to a ground power supply line 210, and a gate terminal that is coupled to a feed-back path on which gate output signal G(n+6) is routed back from a succeeding gate driver circuit that is six rows below. The signal that is received via the feedback path may be used for resetting node X back down to a low potential and is therefore sometimes referred to as a "reset" control signal.

Figure 6:
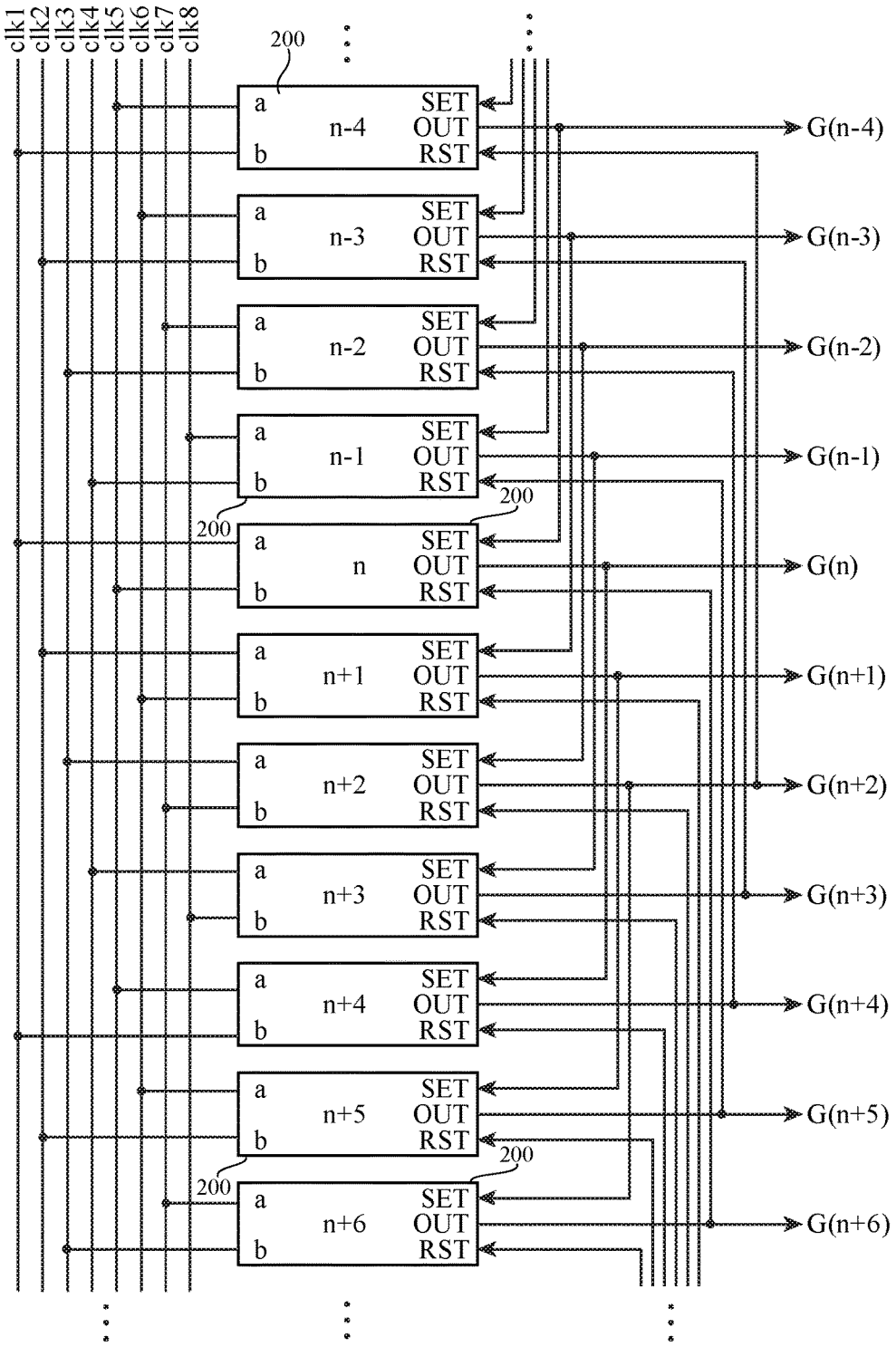
FIG. 6 is a diagram showing gate driver circuits connected in a chain in accordance with an embodiment.

An exemplary routing arrangement showing how different gate driver circuits 200 may be interconnected in a chain to form gate driver circuitry 18 (FIG. 2) is shown in FIG. 6. A given gate line driver unit in the chain may be referred to as gate line driver unit "n" that is configured to output a corresponding gate line output signal G(n). The gate line driver unit preceding the given driver unit in the chain may be referred to as gate line driver unit "(n−1)" that is configured to output a corresponding gate line output signal G(n−1). The gate line driver unit immediately following the given driver unit in the chain may be referred to as gate line driver unit "(n+1)" that is configured to output a corresponding gate line output signal G(n+1). Driver units preceding unit (n−1) may be referred to as units (n−2), (n−3), (n−4) . . . , whereas driver units succeeding unit (n+1) may be referred to as units (n+2), (n+3), (n+4), etc.

In the example of FIG. 6, each gate driver unit has an output that is coupled to an input (e.g., the set input) of a subsequent gate driver unit via a feed-forward path. For example, gate line output G(n−4) may be routed to gate driver unit n; gate line output G(n) may be routed to gate driver unit (n+4), gate line output G(n+1) may be routed to gate driver unit (n+5), etc. Connected in this way, an asserted gate line pulse signal can be propagated down the chain of gate driver units to provide desired raster scanning (e.g., so that new display pixel values can be sequentially written into the display pixel array on a row-by-row basis).

The output of each gate driver unit may also be fed back to another input (e.g., the reset input) of a corresponding gate driver unit that is six rows above that gate driver unit (as an example). As shown in FIG. 6, gate line output G(n+6) may be fed back to gate driver unit n. As another example, gate line output signal G(n+2) may be fed back to gate driver unit (n−4). Connected in this way, the output signal of a second gate driver unit subsequent to (but not necessarily immediately following) a first gate driver unit in the chain may be used to reset the gate line output signal of the first gate driver unit (e.g., assertion of the output signal generated by the second gate driver unit may drive the output signal of the first gate driver unit low).

The feed-forward and feedback routing scheme of FIG. 6 is merely exemplary and does not serve to limit the scope of the present invention. In general, the output of each gate driver unit may be fed back to any suitable preceding gate driver unit (e.g., the output of a given gate driver unit may be fed back to a corresponding gate driver unit that is less than six rows above the given gate driver unit or more than six rows above the given gate driver unit) and may be fed forward to any succeeding gate driver unit in the chain (e.g., the output of a given gate driver unit may be fed forward to a corresponding gate driver unit that is less four rows above the given gate river unit or more than four rows above the given gate driver unit).

Still referring to FIG. 6, each gate driver 200 along the chain may receive selected clock signals from a group of eight clock signals that are phase offset with respect to one another. The eight clock signals may include clock signals Clk1, Clk2, Clk3, Clk4, Clk5, Clk6, Clk7, and Clk8. Each of these clock signals may exhibit different phase delays. For example, signal Clk2 may exhibit a 45° phase delay with respect to signal Clk1; signal Clk3 may exhibit a 90° phase delay with respect to signal Clk1; signal Clk4 may exhibit a 135° phase delay with respect to signal Clk1; signal Clk5 may exhibit a 180° phase delay with respect to signal Clk1; . . . ; and signal Clk7 may exhibit a 315° phase delay with respect to signal Clk1. The clock signals Clk1-8 may be generated using a phase-locked loop circuit and a phase interpolator (as an example). The use of eight clock signals is merely illustrative. If desired, four clock signals that are spaced 90° apart may be used; 12 clock signals that are spaced 30° apart may be used; 16 clock signals that are spaced 22.5° apart may be used; etc.

In the example of FIG. 6, gate driver unit n may have a first (a) clock input that receives signal Clk1 and a second (b) clock input that receives signal Clk5. Signal Clk5 exhibits a 180° phase delay with respect to signal Clk1. Similarly, gate driver unit (n+1) may have a first clock input that receives signal Clk2 and a second (b) clock input that receives signal Clk6. Signal Clk6 also exhibits a 180° phase delay with respect to signal Clk2. Configured in this way, each gate driver unit 200 receives a selected one of the eight clock signals and an inverted/complementary version of the selected clock signal.

Referring back to FIG. 5, the clock signal CLKa routed via path 216 is received at the first (a) input of gate driver 200, whereas the clock signal CLKb routed via path 218 is received at the second (b) input of gate driver 200. As described above, signal CLKb is an inverted version of signal CLKa.

Transistor 220 may have a first source-drain terminal that receives signal CLKb via clock routing path 218, a second source-drain terminal that is coupled to another intermediate node Y, and a gate terminal that is coupled to node X. Transistor 222 may have a drain terminal that is coupled to node Y, a gate terminal that receives the reset signal (e.g., signal G(n+6)) via the feedback path, and a source terminal that is coupled to ground 210. Last but not least, transistor 206 may have a drain terminal that is coupled to the gate driver output, a gate terminal that is coupled to node Y, and a source terminal that is coupled to ground line 210.

Figure 7:
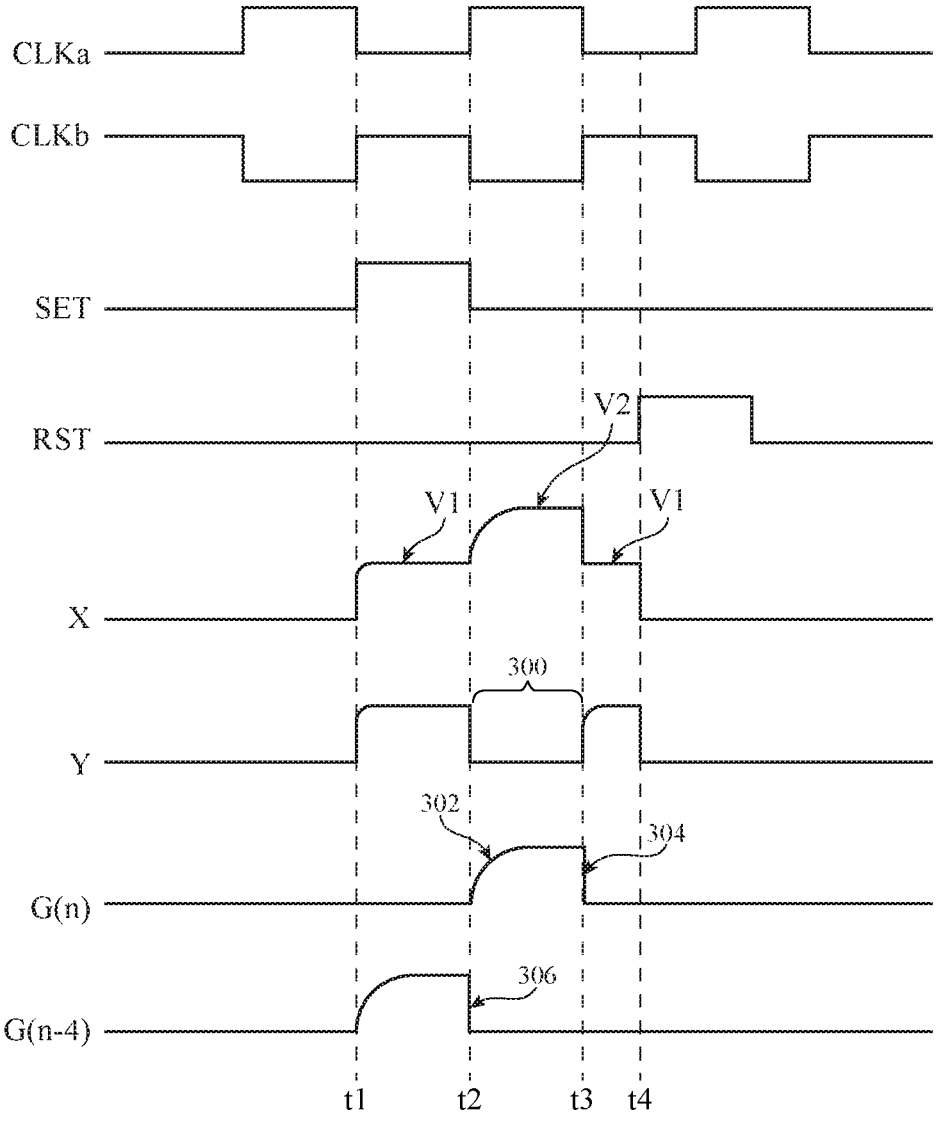
FIG. 7 is a timing diagram that illustrates the operation of a gate driver circuit of the type shown in FIG. 5 in accordance with an embodiment.

FIG. 7 is a timing diagram that illustrates the operation of gate driver circuit 200. As shown in FIG. 7, clock signals CLKa and CLKb are complementary versions of each other. At time t1, the set signal (e.g., feed-forward signal G(n−4)) may be pulsed high. As a result of the set signal being asserted, transistor 212 is turned on to pull node X high to voltage level V1, which in turn also activates transistor 220 to pull node Y high.

At time t2, signal CLKa pulses high while signal CLKb pulses low. In particular, signal CLKb falling low will drive node Y down to ground (see, interval 300) using activated transistor 220 as a pulldown path. Node Y being pulled down to ground then shuts off transistor 206. When transistor 206 is turned off, the gate output G(n) can be driven high following the waveform of signal CLKa. Since there is nowhere for the voltage on capacitor 204 to discharge (i.e., node X is floating since transistors 212 and 214 are both deactivated during interval 300), the rise in voltage at output G(n) will cause node X to rise further to an even higher voltage level V2.

At time t3, signal CLKa clocks low while signal CLKb clocks high. Signal CLKb rising high will drive node Y back high using activated transistor 220 now as a pull-up path. Node Y being pulled back high reactivates transistor 206 to help pull G(n) back down to ground. Since the voltage on capacitor 204 still has nowhere to discharge, the drop in voltage at output G(n) will cause node X to drop back down to voltage level V1. At time t4, the reset signal (e.g., the feedback signal G(n+6)) may be pulsed high. As a result of the reset signal being asserted, transistors 214 and 222 are turned on to pull node X and node Y back down to ground, respectively. Each row in the gate driver chain may be activated successively in this way to sequentially assert the gate driver output lines.

Configured and operated in this way, transistor 206 can be sized relatively large to help meet fall time requirements for the gate driver output signal (e.g., to help ensure that falling edge 304 meets performance criteria). In other words, at time t3, both the buffer transistor 202 and transistor 206 can serve as pulldown transistors to help pull output G(n) down to ground. The use of a dual pulldown arrangement can help the display achieve high refresh rates (e.g., refresh rates of 120 Hz and beyond). If transistor 206 is appropriately sized to provide the desired pulldown drive strength, buffer transistor 202 may be configured with a relatively small size to help reduce clock loading (e.g., to minimize the parasitic capacitive loading at clock routing path 216), which can help substantially reduce dynamic power consumption. As an example, transistor 206 may be five to ten times the size of transistor 202.

Transistor 220 is interposed between transistor 206 and clock routing path 218. In general, transistor 220 should be sized relatively small compared to the buffer transistor to minimize the amount of clock loading on path 218. As an example, transistor 220 may be five to ten times smaller than the size of transistor 202. Configured in this way, transistor 220 serves as a clock isolation circuit that isolates the large parasitic capacitance associated with transistor 206 from clock routing path 218, which also helps to reduce dynamic power consumption. In other words, transistor 206 can be sized sufficiently large without increasing clock loading because of isolation transistor 220. Moreover, it might be worth noting that node X is only asserted once per frame, so node Y is only driven high once per frame. As a result, large pulldown transistor 206 is not constantly exposed to a time-varying signal such as a clock signal, which helps to substantially improve its reliability over time.

Since transistor 202 is sized much smaller than a conventional gate driver output transistor (i.e., transistor 102 of FIG. 3), the corresponding gate driver output signal G(n) may exhibit an asymmetric waveform. In particular, the rising edge 302 of the gate driver output signal may be relatively slow compared to its fall time. An asymmetric gate waveform provided in this way may actually be advantageous in helping to reduce crosstalk between different gate lines. For example, data may be latched by a given display pixel at the falling edge 306 of gate driver output signal G(n−4), at time t2. A fast rising edge at signal G(n) would actually result in an instantaneous voltage perturbation at a common voltage node, which can cause data to be inaccurately latched by the given pixel. A relatively slow rising edge 302 at signal G(n) would substantially reduce any instantaneous voltage coupling to the common voltage node, which will allow data to be more accurately latched by the given pixel.

The circuit configuration of FIG. 5 is merely illustrative and does not serve to limit the scope of the present invention. If desired, gate driver circuit 200 may include more than one capacitor to help provide temporary storage, additional pulldown transistors to help improve gate driver output fall time, other types of clock isolation switches, and other control circuitry for supporting the operation of gate driver 200. The sizing described above with reference to "larger" and "smaller" sizing is directly indicative of the drive strength of that transistor. For example, a larger transistor should exhibit greater drive strength relative to a smaller transistor. Techniques other than the sizing (e.g., transistor width) of transistors can be employed to adjust the drive strengths such as changing the threshold voltage, gate length, etc.

The foregoing is merely illustrative of the principles of this invention and various modifications can be made by those skilled in the art without departing from the scope and spirit of the invention. The foregoing embodiments may be implemented individually or in any combination.

What is claimed is:

1. An electronic device, comprising:

an array of display pixels arranged in rows and columns; and gate driver circuitry that is coupled to the array of display pixels and that includes a gate driver having an output at which a corresponding gate line output signal is provided to display pixels arranged along a corresponding row in the array, and wherein the gate driver comprises:

a buffer transistor having a first source-drain terminal that receives a clock signal and a second source-drain terminal that is connected to the output;

a pulldown transistor that is connected in series with the buffer transistor and that exhibits greater drive strength than the buffer transistor, wherein the buffer transistor and the pulldown transistor are simultaneously on to drive the gate line output signal low, and wherein the gate line output signal has a rise time and a fall time that is substantially shorter than the rise time; and a clock isolation transistor that receives an additional clock signal that is complementary to the clock signal and that is connected to a gate terminal of the pulldown transistor, wherein the buffer transistor has a gate terminal, wherein the clock isolation transistor has a gate terminal, and wherein the gate terminal of the buffer transistor is shorted to the gate terminal of the clock isolation transistor.

2. The electronic device defined in claim 1, wherein the gate driver further comprises:

a capacitor having a first terminal that is connected to a gate terminal of the buffer transistor and a second terminal that is connected to the output.

3. The electronic device defined in claim 1, wherein the clock isolation transistor exhibits a smaller drive strength than the buffer transistor.

4. An electronic device, comprising:

an array of display pixels arranged in rows and columns; and gate driver circuitry that is coupled to the array of display pixels and that includes a gate driver having an output at which a corresponding gate line output signal is provided to display pixels arranged along a corresponding row in the array, and wherein the gate driver comprises:

a buffer transistor having a first source-drain terminal that receives a clock signal and a second source-drain terminal that is connected to the output;

a pulldown transistor that is connected in series with the buffer transistor and that exhibits greater drive strength than the buffer transistor, wherein the buffer transistor and the pulldown transistor are simultaneously on to drive the gate line output signal low, and wherein the gate line output signal has a rise time and a fall time that is substantially shorter than the rise time;

a clock isolation transistor that receives an additional clock signal that is complementary to the clock signal and that is connected to a gate terminal of the pulldown transistor;

a first transistor that is coupled in series with the clock isolation transistor and that has a gate terminal; and a second transistor that is connected to the buffer transistor and the clock isolation transistor, wherein the second transistor has a gate terminal that is shorted to the gate terminal of the first transistor.

5. The electronic device defined in claim 4, wherein the gate driver further comprises:

a third transistor that is connected in series with the second transistor, wherein the third transistor receives another gate line output signal from a preceding gate driver in the gate driver circuitry.

6. A method of operating a gate driver that includes a buffer transistor and a pulldown transistor coupled in series, the method comprising:

receiving a first clock signal at a source-drain terminal of the buffer transistor;

with a clock isolation transistor, receiving a second clock signal that is inverted with respect to the first clock signal and selectively passing through a low voltage to deactivate the pulldown transistor;

generating an output signal at a node that is coupled between the buffer transistor and the pulldown transistor;

using only the buffer transistor to pull the output signal high;

using both the buffer transistor and the pulldown transistor to pull the output signal low, wherein using only the buffer transistor to pull the output signal high comprises providing a rise time for the output signal, and wherein using both the buffer transistor and the pulldown transistor to pull the output signal low comprises providing a fall time that is substantially shorter than the rise time for the output signal;

receiving an asserted set signal to turn on the buffer transistor and the clock isolation transistor; and receiving an asserted reset signal to turn off the buffer transistor, the clock isolation transistor, and the pulldown transistor.

* * * * *